United States Patent [19]

Kuhar et al.

[11] Patent Number: 4,982,776

[45] Date of Patent: Jan. 8, 1991

[54] CORD LOCK FOR A VENETIAN BLIND OR A SHADE

[75] Inventors: Otto Kuhar, Garfield; Robert C. Kross, Kearny, both of N.J.

[73] Assignee: Levolor Corporation, Sunnyvale, Calif.

[21] Appl. No.: 314,649

[22] Filed: Feb. 23, 1989

[51] Int. Cl.[5] ..... E06B 9/324

[52] U.S. Cl. ..... 160/178.2; 24/134 R

[58] Field of Search ..... 160/178.2, 178.1, 168.1; 24/134 R, 134 KB, 132 R

[56] References Cited

U.S. PATENT DOCUMENTS

| | | | |
|---|---|---|---|
| 2,357,911 | 9/1944 | Schaefer | 160/178.2 X |
| 4,180,118 | 12/1979 | Vecchiarelli | 160/178.2 |
| 4,245,688 | 1/1981 | Vecchiarelli | 160/178.2 |
| 4,250,597 | 2/1981 | Ford et al. | 160/178.2 X |
| 4,327,797 | 5/1982 | Nakajima et al. | 160/178.2 X |
| 4,352,386 | 10/1982 | Butler et al. | 160/178.2 |
| 4,476,909 | 10/1984 | Anderle et al. | 160/178.2 |
| 4,637,445 | 1/1987 | Nilsson | 160/178.2 |
| 4,722,383 | 2/1988 | Kross | 160/178.2 |
| 4,727,921 | 3/1988 | Vecchiarelli | 160/168.1 |

*Primary Examiner*—David M. Purol

*Attorney, Agent, or Firm*—Skjerven, Morrill, MacPherson, Franklin & Friel

[57] ABSTRACT

A cord lock for a venetian blind or shade, such as a pleated shade, having a housing with a stationary pulley and a serrated cam or rivet guided in parallel, aligned S-shaped slots, the cam locking the raised lift cord of the blind or shade against the pulley. The S-shape of the slot maximizes the angle of approach of the slot with respect to the cord and pulley to thereby increase the sensitivity of the lock.

6 Claims, 1 Drawing Sheet

CORD LOCK FOR A VENETIAN BLIND OR A SHADE

BACKGROUND OF THE INVENTION

The present invention relates to a cord lock for a venetian blind or a shade, such as a pleated shade, and more specifically to a lock for the lift cord of such venetian blind or shade.

Different forms of such cord locks are known in the art, as for example disclosed in U.S. Pat. Nos. 4,180,118; 4,245,688; 4,352,386; and 4,476,909. They have stationary pulleys made from either plastic material or metal, and are either rotatably mounted or are fixed in a housing, and also have a floating serrated or knurled rivet which can move up and down in slots in the housing. The lift cord lifting and lowering the blind or shade passes between the pulley and the rivet. When the lift cord is to be locked in position the rivet engaged by the cord travels upwardly with the cord, caused by the weight of the blind, and the cord becomes wedged between the rivet and the pulley. When the cord is pulled downwardly the rivet drops away from the pulley and cord, and the blind or shade is released.

It is intended that the rivet gently moves the lift cord against the pulley thereby locking it in place, when the blind or shade has been raised or lowerd to the desired position, and the lift cord is released. It must be assured that the cord lock operates in a "crash-proof" manner, i.e. that it maintains the blind or shade in the locked position so that it does not come crashing down.

It is an object of the present invention to provide a cord lock for a venetian blind or shade, in which both the firmness and sensitivity of the cord lock is increased without jeopardizing the "crash-proof" feature of the cord lock.

BRIEF SUMMARY OF THE INVENTION

Applicants have achieved this object by maximizing the angle of approach of the slot, the size of the cord, and the diameter and location of the pulley.

They have found that the degree of grip placed on the lift cord by the serrated rivet in the locked position is a function of the approach of the slot which the serrated rivet rides, and the angle of the slot in relation to the thickness of the lift cord.

In particular, they have found that an S-shaped slot best achieves the desired result.

BRIEF DESCRIPTION OF THE DRAWING

The invention will be explained, by way of example, in the following specification and drawings, in which.

DETAILED DESCRIPTION OF A PREFERRED EMBODIMENT

Figure 1:
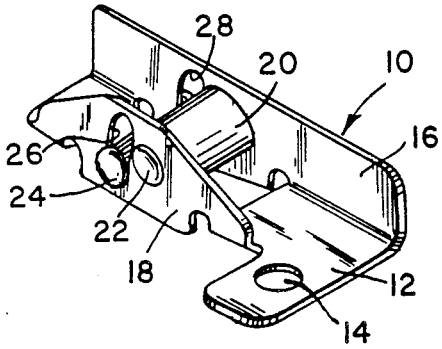
FIG. 1 is a perspective view of the cord lock of the present invention.
Figure 2:
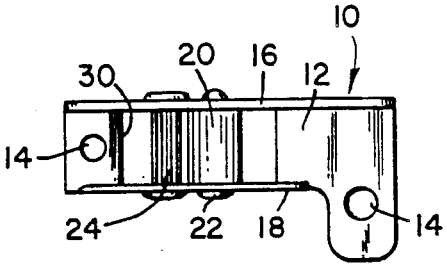
FIGS. 2 to 4 are respectively a top view, a side view, and end view of the cord lock.
Figure 3:
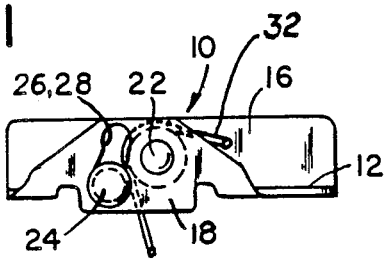
Figure 4:
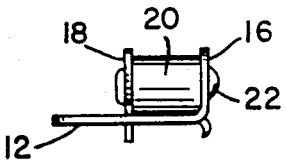

Referring now to the drawing in detail, the cord lock according to the present invention comprises a cord lock housing 10 which may for instance be estamped out from an integral piece of metal. Housing 10 has a base 12 which may be connected to the head channel of a venetian blind or a pleated shade by screws (not shown) extending through bores 14 in base 12. The housing has two sidewalls 16 and 18 rising upwardly at right angles to the base 12. A stationary metal pulley 20 extends between sidewalls 16 and 18 and is held in place by rivet 22. A serrated or knurled rivet or cam 24 floats within slots 26, 28 provided respectively in sideways 16, 18. The slots are identical and in alignment with each other. In the center of base 12 there is large opening 30. As shown in FIG. 3, a lift cord 32 of a venetian blind or a shade passes from underneath through opening 30 between the serrated cam 24 and the stationary pulley 20 and from there over pulley 20.

An essential feature of the present invention is the shape of slots 26, 28. It is S-shaped, which maximizes the cord lock's gripping strength by increasing the slot's angle of approach at the point where lift cord 32 comes into direct contact with pulley 20. The increased slope at this location increases both the firmness and sensitivity of the cord lock without the latter losing its "crash-proof" feature. Each slot 26, 28 has a bottom leg *26a*, *28a* and a top leg *26b*, *28b* respectively. The bottom legs *26a*, *28a* allow rivet or cam 24 to fall away from lift cord 32, when it is released, and to stand free so as not to rub against the cord. Both the bottom and top legs of the slots may be provided with serrations or grooves *26c*, *28c* as means to keep the rivet square and on track.

Figure 5:
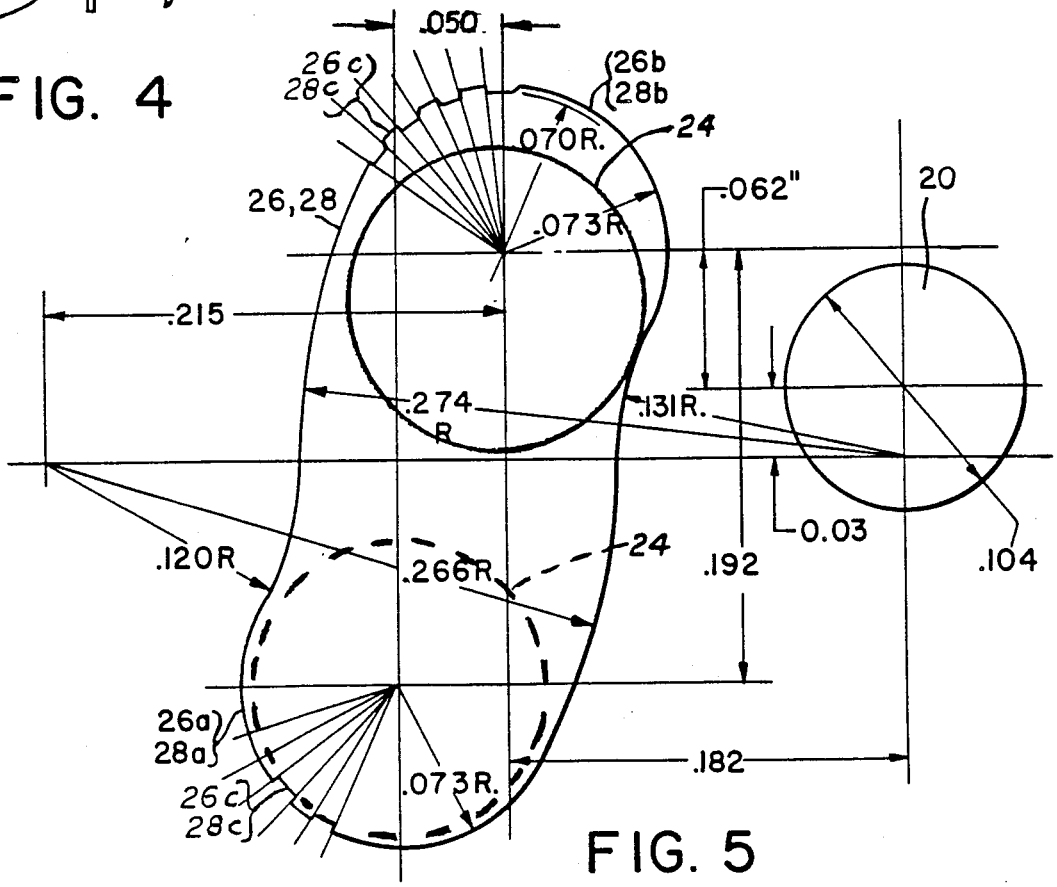
FIG. 5 is a diagramatic showing, on an elarged scale, of the location and shape of the slot the serrated rivet of the cord lock, in relation to the pulley and the lift cord.

FIG. 5 shows the rivet 24 within S-shaped slot in full lines when lift cord 32 is locked, and in dash lines in the released position of cord 32. This figure also shows the dimensions of the slot and pulley. The diameter of the lift cord is 0.045", and that of the rivet 0.104".

Also, as seen in FIG. 5, the horizontal bisector of the slot 26 is below the horizontal bisector of pulley 20 permitting a curvilinear medial section of the slot juxtaposed to the pulley to control the movement of the cam 24 into the full line position to grip the lift cord against the pulley.

We claim:

1. A cord lock for a lift cord of a blind or shade, comprising: a housing having a base for connection to a head channel of the blind or shade, two side walls in spaced, substantially parallel relationship to each other and extending substantially perpendicularly to said base, each side wall having a slot, said slots being in alignment with each other, a cam extending in said housing through said slots and being slidably and non-removably received in said slots, and a pulley non-rotatably mounted in said housing spaced from said slots, each slot having an S-shaped contour, with a bottom leg adjacent said base and a top leg remote therefrom, said bottom leg curving away from said pulley, said top leg curving towards said pulley, the relationship between the location of said slot, and said pulley and the dimensions of said slot, pulley and lift cord being such that lift cord passing in said housing over said pulley and between said cam and said pulley is releasably locked between said cam and pulley.

2. A cord lock according to claim 1, wherein said contour has a bottom leg, a top leg and an intermediate leg between said bottom and top legs, each of said bottom leg and said top leg having a portion adjacent said pulley and a portion remote from said pulley, said portions remote from said pulley being provided with serrations.

3. A cord lock according to claim 1, wherein a horizontal bisector of said slots extends in a plane below a horizontal bisector of said pulley.

4. A cord lock for a lift cord of a blind or shade, comprising:

a housing having a base for connection to a head channel of the blind or shade, and two side walls extending from said base and in spaced, substantially aligned relationship to each other, each side wall having a slot, said slots being in alignment with each other;

a cam extending in said housing through said slots and being slidably held and received in said slots; and a pulley mounted in said housing spaced from said slots, each slot having a S-shaped counter, with a bottom leg adjacent said base and a top leg remote therefrom, said bottom leg curving away from said pulley, said top leg curving towards said pulley, the relationship between the location of said slots, and said pulley and the dimensions of said slots, pulley and lift cord being such that lift cord passing in said housing over said pulley and between said cam and said pulley is releasably locked between said cam and pulley.

5. A cord lock according to claim 4, wherein a horizontal bisector of said slots extends in a plane below a horizontal bisector of said pulley.

6. A cord lock according to claim 4 wherein said S-shaped contour includes a curvilinear medical section juxtaposed to said pulley and providing a guideway for said cam to ride curvingly upward in said slots into said top legs to grip said cord against said pulley and wherein release of said cord permits said cam to fall away from said cord into said bottom legs.

* * * * *

UNITED STATES PATENT AND TRADEMARK OFFICE

CERTIFICATE OF CORRECTION

PATENT NO. : 4,982,776

DATED : January 8, 1991

INVENTOR(S) : Otto Kuhar and Robert C. Kross

It is certified that error appears in the above-identified patent and that said Letters Patent is hereby corrected as shown below:

Column 2, lines 54 & 55, "slot" should read --slots--.

Signed and Sealed this

Twenty-fifth Day of August, 1992

*Attest:*

DOUGLAS B. COMER

*Attesting Officer*

*Acting Commissioner of Patents and Trademarks*